US005875636A

United States Patent [19]

Kamody

[11] Patent Number: 5,875,636

[45] Date of Patent: Mar. 2, 1999

[54] PROCESS FOR THE CRYOGENIC TREATMENT OF METAL CONTAINING MATERIALS

[75] Inventor: Dennis J. Kamody, New Kensington, Pa.

[73] Assignee: Nu-Bit, Inc., New Kensington, Pa.

[21] Appl. No.: 941,739

[22] Filed: Oct. 1, 1997

[51] Int. Cl.[6] ..... F25D 13/06

[52] U.S. Cl. ..... 62/64; 62/78

[58] Field of Search ..... 62/64, 78

[56] References Cited

U.S. PATENT DOCUMENTS

| | | | |
|---|---|---|---|
| 2,624,688 | 1/1953 | Svenson | 62/64 |
| 2,949,392 | 8/1960 | Willey | 148/125 |
| 3,185,600 | 5/1965 | Dullberg | 148/125 |
| 3,891,477 | 6/1975 | Lance | 148/125 |
| 4,482,005 | 11/1984 | Voorhees | 165/2 |
| 4,739,622 | 4/1988 | Smith | 62/78 |
| 5,044,422 | 9/1991 | Leuker | 165/2 |
| 5,259,200 | 11/1993 | Kamody | 62/64 |

*Primary Examiner*—Ronald Capossela
*Attorney, Agent, or Firm*—Armstrong, Westerman, Hattori, McLeland & Naughton

[57] ABSTRACT

A process for treating an article of metal containing material having a minimum cross-sectional dimension. The process includes providing the article at ambient temperature or below and completely immersing the article in a cryogenic fluid over a time period at least equal to 10 minutes times a value of the minimum cross-sectional dimension in inches. The process further includes withdrawing the article from contact with the cryogenic fluid, and immediately subjecting the article to a flow of gaseous fluid sufficient to raise the temperature of the article until the article reaches ambient temperature.

9 Claims, 2 Drawing Sheets

PROCESS FOR THE CRYOGENIC TREATMENT OF METAL CONTAINING MATERIALS

The present invention relates generally to processes for treating metal containing materials such as steels, and, more particularly, to cryogenic type treatment processes for improving or enhancing properties such as shockability, wearability, stability and hardness metal containing materials where, in the processes, specific time relationships are utilized to treat the materials at cryogenic temperatures and then, preferably, the materials are immediately heated back to ambient temperature after treatment at cryogenic temperature.

While the process of the subject invention will be discussed primarily hereinafter with reference to processes for improving the properties of steel type materials using liquid nitrogen as the cryogenic material, it is to be understood that the use and the application of the process of the subject invention are not thereby so limited. For example, the processes of the invention may be useful in the treatment of many other metal containing materials not including iron, although their use in connection with iron containing materials is presently preferred. In addition, other cryogenic media may be utilized in the processes such as other liquified or solidified gases.

In the manufacture of tools and tool components, machinery, engine parts, wear surfaces and the like articles from various steels which are used for high wear applications, it is common practice to subject the steel to one or more treatments, either before or after formation of the steel carbide, so as to modify the properties of at least the exterior of the components and thereby provide the articles with a longer wear life and the like. A number of thermal type processes are known in the metallurgical arts to enhance the properties of metal containing materials such as steels. One widely used class of such metallurgical processes generally involve a heat treatment of the metal containing article, that is, elevating the temperature from ambient or form forming temperatures and then cooling. Another common class of enhancement processes is sometime known as quenching and typically involves forming an article of the desired metal containing material and then rapidly lowering the temperature of the article followed by a return of the article to ambient temperature. A combination of the two classes of treatment processes is often used.

In either type of class of enhancement processes, the general intent is to modify or alter the microstructure of the metal containing material and/or to relieve stress or other physical conditions in the materials. In the case of steel type materials, transformation of the material from an austenitic state or condition to the martensitic state is the desired result. Generally, it has been found that a heat type treatment for modifying a metal containing material results in less than 100% of the material being transformed from the austenitic to the martensitic state, a transformation typically on the order of only 85% to 95%. Even with a heat treatment using the utmost care and the best available treatment equipment, transformations in excess of 95 are very difficult to achieve. As a consequence, heat treated articles are oftentimes further subjected to a quenching type treatment so as to maximize the transformation of the steel from one state to another.

A quenching type treatment may involve the reduction in temperature from an elevated temperature (a temperature significantly above room temperature) to ambient temperature or below or may involve the reduction of temperature of the article from room temperature or both. The change in temperature maybe accomplished quickly or slowly or combinations thereof in modifying the condition of the article from one temperature to another.

For example, a typical cryogenic quenching process of the metallurgical type used in the manufacture of tool steel articles includes a relatively slow reduction in temperature from room temperature (typically about 70° F. to an intermediate or conditioning temperature below 0° F. such as −100° F. In a common example, the article of tool steel to be treated is lowered over open container containing a bath of cryogenic material such as nitrogen. Thus, the article is gradually cooled to the intermediate temperature by being suspending directly over the bath of liquid nitrogen and in close proximity to the surface of the liquid nitrogen. The article is maintained in this position over the liquid nitrogen bath until its temperature reaches the intermediate temperature throughout. The generally accepted practice in the metallurgical arts is to allow a minimum of about one hour per inch cross section of the article to reach this intermediate temperature.

Thereafter, the article is lowered into and immersed in bath of liquid nitrogen so as to achieve a rapid reduction in temperature of the tool steel article to a cryogenic temperature approximately the temperature of the liquid nitrogen, that is about −327° F. Like the first step of this procedure, the generally accepted practice is to treat the article by immersion in the bath for a minimum of about one hour per inch cross-section of the article at the cryogenic temperature provided by the liquid nitrogen.

According to conventional procedures, after the article has been immersed in the bath for the requisite time period as noted above, the article is removed from direct contact with the liquid nitrogen by being elevated out of the bath and again is suspended over the surface of the bath of liquid nitrogen or otherwise kept in close proximity to the bath such that the article only slowly and gradually increase in temperature. It is the general practice to allow the article to increase in temperature in this fashion until the temperature again reaches the intermediate temperature. Again, a minimum of about one hour per inch of cross-section of the article is generally allowed for this step of the process. Thereafter, the article is moved away from the liquid nitrogen or otherwise separated therefrom and is allowed to return to room temperature by contact with still or quiet ambient air. The time period generally utilized for this step is on the order of a minimum of about one hour per inch of minimum cross-section of the article being treated.

As is apparent from the above description, the time period necessary to complete each step in the cycle of the treatment process generally is a minimum of about an hour per cross-section inch of the article being treated. However, it has been fairly conventional to increase the time periods for each step of the process to ensure that treatment is complete. Thus, for example, many of those practicing the above process routinely provide a safety factor of two or three or more in determining the respective time periods for the steps and as a consequence, overall treatment time periods of up to 50 hours or more for an article having a cross-sectional minimum dimension of one inch are often used.

While the treatment metal containing materials such as steels with the above described quenching procedure produces articles of desirable and enhanced characteristics, the costs associated with such treatment tend to be high per article. A significant factor affecting the relatively high added costs is the equipment costs in providing and handling cryogenic fluids such as liquid nitrogen and which is compounded by the relatively long treatment times required to produce articles having the desired degree of enhanced properties. The relatively high costs of cryogenic type quenching processes for use in metallurgical applications have tended to be a negative factor in implementation of such processes by both product manufacturers and the metal treating industry.

To minimize the time necessary for a cryogenic treatment of metal containing materials and to provide for decreased costs associated with such cryogenic treatments, an improved cryogenic treatment process was taught in my U.S. Pat. No. 5,259,200, issued Nov. 9, 1993. The disclosure of this patent is incorporated by reference herein in its entirety.

Briefly, the process disclosed in the above patent was directed to a process for treating an article of metal containing material, the process comprising contacting the article at ambient temperature or below with a cryogenic material for a time period up to or equal to about ten minutes, withdrawing the article from contact with the cryogenic material, and immediately subjecting the article to a flow of gaseous fluid sufficient to raise the temperature of the article an average of at least about one degree F. per minute until the article reaches ambient temperature.

Among other things, this disclosed process for the cryogenic treatment of articles of metal containing material can be conducted in significantly less time than conventional cryogenic processes and thus increases productivity by reducing work-in-progress time during manufacturing of an article. In addition, the disclosed process for the cryogenic treatment of articles of metal containing material can be conducted at significantly less cost than conventional cryogenic processes. However, with this process, immersion of the article in the cryogenic fluid may cause damage to the article due to thermal shock or the like.

SUMMARY OF 1HE INVENTION

It therefore is a feature of the subject invention to provide an improved process for the cryogenic treatment of articles of metal containing material which is conducted using a controlled immersion for the cryogenic treatment cycle, so that possible stress or tensile cracking and distortion of the article are thereby minimized or even eliminated.

It also is a feature of the subject invention to provide a process for the cryogenic treatment of articles of metal containing material which is conducted using a controlled immersion for the cryogenic treatment cycle, the controlled immersion being conducted over a predetermined period of time in a continuous or stepped type immersion, preferably with the article being immersed obliquely to its major axis.

It further is a feature of the subject invention to provide a process for the cryogenic treatment of articles of metal containing material which minimize damage to the article upon contact with cryogenic material due to thermal shock and the like.

It is another feature of the present invention to provide a process for the cryogenic treatment of articles of metal containing material which can be conducted at significantly less cost than conventional cryogenic processes.

It is a further feature of the subject invention to provide a process for the cryogenic treatment of articles of metal containing material, particularly iron containing material, which produces articles having, among other things, improved properties such as enhanced shockability, wearability, stability and hardness and thus increased life for the articles.

It is yet another feature of the subject invention to provide a process for the treatment of metal containing materials that is particularly adapted for the treatment of tool steels so as to provide articles of such tool steels with improved stability, shockability and hardness and extended wearability.

Briefly, the present invention comprehends in its broader aspects a process for treating an article of metal containing material having a minimum cross-sectional dimension, the process comprising providing the article at ambient temperature or below, completely immersing the article in a cryogenic fluid over a time period at least equal to 10 minutes times a value of the minimum cross-sectional dimension in inches, withdrawing the article from contact with the cryogenic fluid, and immediately subjecting the article to a flow of gaseous fluid sufficient to raise the temperature of the article until the article reaches ambient temperature.

Further features, objects and advantages of the present invention will become more fully apparent from a detailed consideration of the arrangement of the steps and conditions of the subject processes as set forth in the following description when taken together with the accompanying drawings.

DETAILED DESCRIPTION OF THE PREFERRED EMBODIMENTS

As was previously mentioned, the subject invention is directed in one of its aspects to an improved process for the cryogenic treatment of metal containing material. For the purposes of illustration only, the subject process is described hereinafter with reference to a particularly preferred process in accordance with U.S. Pat. No. 5,239,200 where an article of tool steel is treated in a bath of liquid nitrogen so as to, among other things, improve the shockability, wearability, stability and hardness of at least the surface of the article.

Figure 1A:
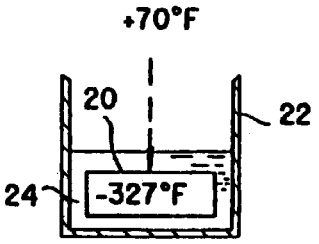
Fig.1a (PRIOR ART)
FIGS. 1*a* and 1*b* form a simplified flow diagram illustrating one embodiment of a process according to U.S. Pat. No. 5,239,200.
Figure 1B:
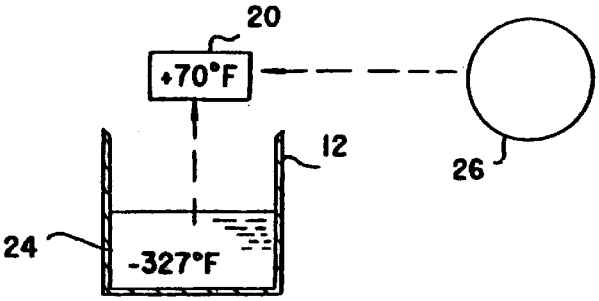
Fig.1b (PRIOR ART)

The particularly preferred process according to this patent is illustrated by the process sequence diagrams of FIGS. 1*a* and 1*b* of the drawings. More specifically, in the process step shown in FIG. 1*a*, article 10 of steel to be treated by the disclosed process of is initially at room temperature, generally about 70° F. Article 10 is then directly lowered or immersed in bath 24 of cryogenic fluid such as liquid nitrogen in container 22 so as to cool the article to a temperature approaching the temperature of the cryogenic fluid, for example to about −327° F. when the cryogenic fluid is liquid nitrogen.

The article 10 is allowed to remain in the cryogenic fluid only for period of time sufficient to for the cryogenic fluid to stop boiling or set period of time, whichever occurs first. For most if not all articles, particularly those having a relatively small minimum dimension, e.g., less than about twelve inches, this latter set time period is about ten minutes. Thus, for at example, a tool steel article having a minimum cross-sectional dimension of about four inches, the maximum time for treatment of the article in the bath of cryogenic fluid would be about ten minutes.

After treatment in bath 14 of cryogenic fluid, article 10 is removed from the bath and separated from any influence from the cryogenic fluid in terms of temperature regulation. Generally, this involves physically separating the article from the bath by a sufficient distance that the temperature of the bath no longer appreciably affects the temperature of the article. Once separated from bath 14, article 10 is immediately subjected to a flow of ambient air created by fan 16 so as to raise the temperature of the article to that approximating ambient or room temperature.

In accordance with the concepts of the present invention, the step of immersing the article in the bath of cryogenic liquid is conducted in a controlled manner, that is, the immersion of the article is not immediate, but is conducted over a defined period of time such that the article is gradually or slowly immersed in the cryogenic liquid.

Figure 2A:
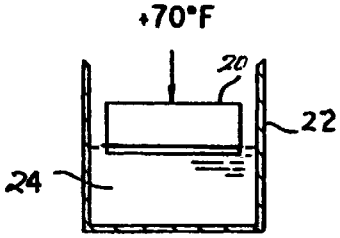
FIGS. 2*a*, 2*b* and 2*c* form a simplified flow diagram illustrating a controlled immersion for a process according to the present invention.
Figure 2B:
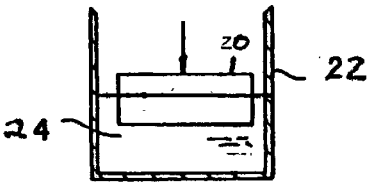
Figure 2C:
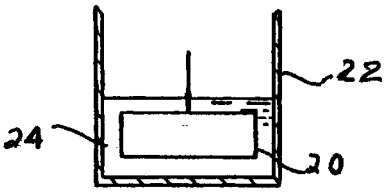

A controlled immersion according to the present invention is illustrated in the sequence diagrams of FIGS. 2*a* though 2*c* of the drawings. More specifically, in the immersion process step shown in FIG. 2*a*, article 20 of steel to be treated by the disclosed process of is initially at room temperature. Article 20 is then lowered partially into bath 24 of the cryogenic fluid in container or vessel 22 so as to start to cool the article to a temperature approaching the temperature of the cryogenic fluid. As the controlled immersion of article 20 proceeds, the article becomes more partially immersed in the cryogenic fluid as shown in FIG. 2*b*. Thereafter, article 20 becomes completely immersed in the bath 24 as shown in FIG. 2*c*. This controlled immersion from initial contact with the fluid to complete immersion of the article according to the invention is accomplished over a minimum defined period of time to minimize potential adverse effects on the article.

Such a controlled immersion can be conducted in a variety of manners. For example, the immersion can be conducted in a continuous or linear rate controlled immersion where the article is immersed at a constant rate into the cryogenic liquid. Generally, it has been determined in accordance with the present invention that, for satisfactory results, the minimum period of time for such a continuous immersion be at least 10 minutes per inch minimum cross-section of the article. That is, for example, the continuous immersion should be conducted for a period of at least ten minutes for an article having a minimum cross-section of one inch, the period being measured from the time the article contacts the cryogenic fluid to the time that the article is completely immersed in the fluid.

Figure 3:
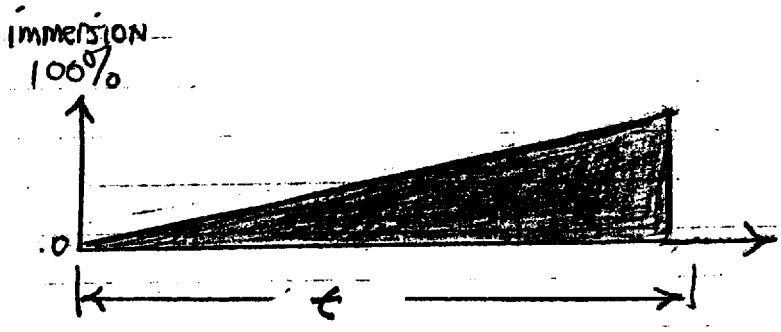
FIG. 3 is a graphical example of a time-immersion relationship for continuous immersion of an article in a cryogenic fluid for a process according to the present invention.

An example of a time-immersion relationship for continuous immersion of an article is illustrated in the graph shown in FIG. 3. The abscissa represent time (t) whereas the ordinate is the percent immersion of the article up to 100% immersion.

As is apparent from this illustrative example of FIG. 3, the immersion is linear, that is, a constant rate of immersion of the article over the minimum period of time (t). While a linear immersion is presently preferred for a continuous immersion because, among other things, ease of operator control, a non-linear immersion is also contemplated by the subject invention. Such a non-linear immersion could be, for example, a slower rate of initial immersion followed by a higher rate of immersion for the remainder of the immersion until complete immersion is achieved. Other variations on this non-linear immersion may also be utilized and are contemplated by the present invention.

The time (t) for the controlled immersion is determined by the following formula:

$$t=(k \text{ minutes/inch cross-section}_{min})(\text{inches in minimum cross-section for article})$$

where k is at least 10, and for articles having a large minimum cross-section of, for example, 10 inches or more and/or complicated geometry, k is preferably at least 20 and, more preferably at least 30. For articles having a minimum cross section of less than one inch, it is generally preferable to utilize a time for immersion of at least 10 minutes regardless of the minimum cross-section of the article.

As another example of controlled immersion according to the present invention, the immersion can be conducted as a "stepped" immersion where a portion of the article is immersed into the cryogenic fluid and then the article held in that position for a predetermined period of time. Thereafter, a further portion of the article is immersed into the cryogenic fluid and the article held in that position for another predetermined period of time. These incremental steps are then repeated, as necessary, until the entire article is immersed in the cryogenic fluid. Preferably, such a stepped immersion of the article is conducted in two or more steps, more preferably in three or more steps. In addition, while the immersion steps need not be equal steps, preferably the steps are approximately equal to ensure proper immersion even with unskilled operators of the process.

Figure 4:
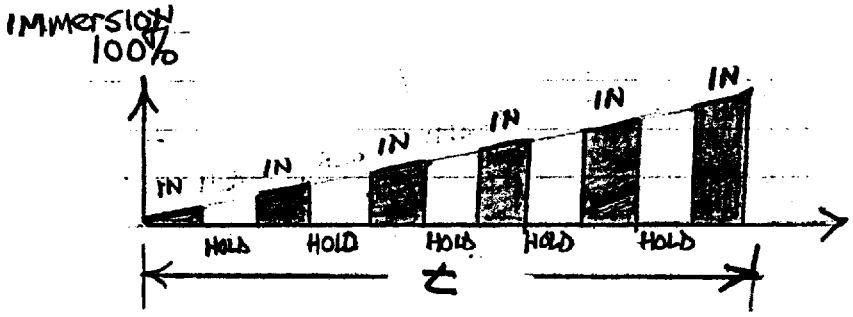
FIG. 4 is a graphical example of the time-immersion relationship for stepped or discontinuous controlled immersion of an article for a process according to the present invention.

An example of a time-immersion relationship for stepped or discontinuous immersion of an article is illustrated in the graph shown in FIG. 4. As in FIG. 3, the abscissa represent time (t) whereas the ordinate is the percent immersion of the article up to 100% immersion. The value of time (t) is determined in the same fashion as described above.

In the example shown in FIG. 4, the immersion steps (indicated by "in") and the hold steps (indicated by "hold") of the controlled immersion are of equal duration. While such a sequence is presently preferred, it is contemplated that the duration of the hold steps and immersion steps could be different from each other and, as well, the hold steps each could differ from each other and the immersion steps each could differ from each other.

A primary purpose of immersing the article into the cryogenic fluid in a controlled manner as described above and in accordance with the present invention is to minimize thermal shock to the article. A second primary purpose of immersing the article in a controlled manner is to minimize tensile rupture which could otherwise damage the article by generating microcracks and the like and/or undesirably altering the microstructure of the article. The controlled immersion according to the present invention tends to condition the article before complete immersion in the form of a directional quench by establishment of a temperature gradient from the initially immersed portion of the article to the most exposed portion of the article. To effectively generate such a direction quenching effect and maximize the beneficial effects of the present invention, preferably the vessel containing the cryogenic fluid is open to the ambient atmosphere as opposed to being a closed vessel where significantly large temperature gradients cannot be easily established.

In a particularly preferred embodiment of the method of the present invention, the controlled immersion is conducted such that the article to be treated is oriented for immersion such that the portion of the article first contacting the cryogenic fluid is a portion of the article a minimum dimension. The particular preferred orientation for a specific article generally is dependent upon the shape of the article.

Figure 5:
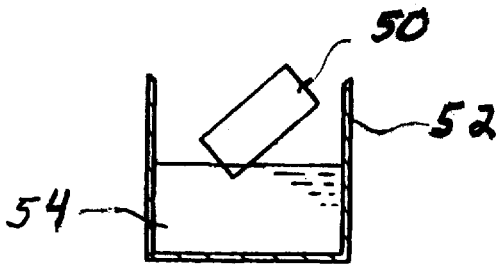
FIG. 5 illustrates a preferred aspect of a controlled immersion for a process according to the present invention.

For example, the article 50 as shown in FIG. 5 has two major dimensions shown which do not significantly differ from each other. Consequently, in accordance with the above preferred embodiment of the present invention, the article is introduced or immersed into the cryogenic fluid 54 contained in container or vessel 52 in an orientation with both its major axes oblique to the surface of the fluid such that a comer of the article first contacts the fluid. As another example, an article in the shape of a rod preferably would be oriented relative to the surface of the bath such that the longitudinal axis of the rod is oblique to the surface, that is, non-perpendicular and non-parallel to the surface.

Thus, such an orientation for the article avoids first contacting the cryogenic fluid with a major surface of the article. Such an orientation for the article being treated tends to, among other things, further minimize thermal shock to the article.

While the above description of the controlled immersion feature of the subject invention has been directed to the preferred embodiment of lowering the article to be treated into a stationary bath of cryogenic fluid, the method of the present invention is not so limited. Alternatively, the article to be treated can be fixed in a position and the bath moved upwardly to contact the article in a controlled type immersion. Upward movement of the bath can be accomplished by physically raising the vessel containing the bath or can be accomplished causing the level of the cryogenic fluid to rise within a vessel by, for example, adding cryogenic fluid to the vessel or by changing the shape of the vessel.

Generally speaking, the conditions for operating the subject process may vary considerably as indicated above depending upon, among other things, the particular material of the article being treated, desired properties of the material depending upon its intended use, the degree to which the material is to be treated, and the particular composition of the cryogenic material being utilized which governs its cryogenic temperature.

Specifically, as was set forth in U.S. Pat. No. 5,239,200, the required rate of air flow in conducting this latter step in the process may vary considerably depending upon, among other things, the temperature of the article upon emergence form the bath, the type of material which forms the article, the mass and shape of the article, and the temperature and conditions, e.g., humidity, of the air. Some of the general considerations in determining the optimum flow rate involve balancing the most rapid increase in temperature for the article to minimize the time required to treat the article with the energy costs and equipment costs associated with the generation of the air flow.

As a general rule, the flow of air should be sufficient to, on average over the temperature range, increase the temperature of the article by at least one degree F. per minute, preferably at least about five degrees F. per minute and more preferably at least about ten degree per minute such as about twenty degrees per minute on average. Obviously, the rate of temperature increase will be the greatest upon emergence of the article from the bath and gradually decrease as the temperature of the article approaches the temperature of the flowing air presuming a constant flow of air. As a general rule, the greater the minimum cross-sectional dimension, the greater the time period should be used for returning the article to ambient temperature. For many materials such as steels and particularly tool steels, the flow of air should be sufficient that the temperature of the article reaches ambient over a maximum time period equal to 10 minutes minimum plus and additional 10 minutes per minimum dimension in inches or portion thereof.

However, on the other hand, the rate of temperature rise in the article in the second step should be limited so as to prevent damage to the article which may occur due to, among other things, thermal stresses resulting in cracking, distortion and deformation, caused by a too rapid increase in temperature of the article. Those of ordinary skill in the art to which the present invention pertains will be able to easily determine an appropriate air flow rate from the above criteria.

In the course of elevating the temperature of the article from the cryogenic temperature, the flow of air tends to quickly remove condensation products such as frost, water droplets and the like which may form on the article upon its emergence from the bath of cryogenic material. As a consequence, any adverse effects which may be caused by a reaction between the condensate and the article such as oxidation are thereby minimized.

While the air of the air flow used in elevating the temperature of the article removed from contact with the cryogenic material preferably is of flow of air at ambient temperature created by mechanical means such as a fan or the like for cost considerations, air from other sources can be used as well. For example, air from a compressed air source, ventilation equipment and the like having the appropriate temperature can be used so long as air does not adversely affect the treated article such as by containing contaminants and the like.

In addition, the process described above with reference to FIG. 1 uses a flow of ambient air to raise the temperature of the article after removal from the bath of cryogenic material, flows of other gases could be used with generally equal effect. For example, the gaseous medium could an inert gas such as nitrogen, a flue gas, a waste gas or the like. If another gaseous medium is used other than air, the gas is preferably at ambient temperature for the considerations mentioned below. Alternatively, other generally inert gaseous media may also be incorporated into the flow of air to elevate the temperature of the article being treated from the cryogenic temperature.

Generally speaking, the metal containing material which can be advantageously treated by the processes of the present invention may vary considerably and can include metallic elements, metal alloys and metal composites either alone or in combination with non-metallic materials such as ceramics, polymeric materials and the like. Suitable metals included in the metal containing materials include iron, nickel, cobalt, copper, aluminum, refractory metals such as tungsten, molybdenum and titanium, combinations, alloys and composites thereof including carbide, nitride and boride containing materials and the like.

The process of the invention has been found to be particularly advantageous for the treatment of iron containing materials including cast iron, iron alloys, iron containing composites as well as for various steels. In the latter regard, various properties of steels such as tool steels used for forming, shaping or cutting materials such as metals, metallic composites, organic materials such as polymers and especially reinforced polymers, have been found to benefit from the process of the present invention, particularly with regard to their shockability, hardness and/or resistance to wear. Such tool steels are oftentimes fabricated into tools such as drill bits, taps, cutting blades, reamers, borers, dies and the like. For example, it has been found that drill bits of tool steel treated according to the process of the present invention may have increased life of at least two up to fifty times or more as compared with similar drill bits not having been treated according to the process of the invention.

The process of the invention has also been found to be particularly advantageous for the treatment of materials known a cemented carbides such as those containing tungsten carbide. Certain classes of cemented carbides such as those known under the designations C1, C5 and C6 containing nickel and cobalt especially benefit in terms of improved shockability, wearability, stability and hardness by treatment at cryogenic temperatures, in particular by the treatment of the process of the present invention when utilizing liquid nitrogen.

The cryogenic material used in the subject process to lower the temperature of the article being treated to a cryogenic temperature can be selected from a variety of materials, the primary considerations in the selection being the temperature of the material and its availability and thus cost, and ease and safety in handling. Generally cryogenic fluids such as liquified gases including liquid nitrogen and liquid oxygen are preferred for use as the cryogenic material. Other commercially significant cryogenic materials include liquified argon, helium and hydrogen. Liquid nitrogen is presently preferred due to its wide availability and low cost as well as its ease and safety in handling and favorable temperature (about −327° F.). Solid cryogenic materials such as solidified carbon dioxide (dry ice) may be employed as the cryogenic material because of low costs and minimal safety hazards associated with its use. However dry ice does have the disadvantage that solid-solid heat transfer between the cryogenic material and the article being treated may not be as efficient as liquid-solid transfer due to limited surface contact.

The container or vessel for the cryogenic fluid used with the process may be of various constructions and designs of the type which are adapted to hold a bath of cryogenic material. Generally such containers are highly insulated and are constructed of materials which are non-reactive with the cryogenic material.

As used herein, the term "cryogenic temperature" generally refers to a temperature below about −100° F., generally below about −150° F., and typically on the order of about −200° F. or below, preferably below about −300° F. The term "ambient temperature" generally refers to a temperature of the external air about article to be treated and can vary from about 0° F. to about 100° F. and includes room temperature. The term is intended to encompass those normal temperatures encountered by an article of metal containing material during processing in a manufacturing facility and thus can include temperatures corresponding to the external environment, e.g., the outside environment, in which the articles typically may be processed or stored. The term "room temperature" generally refers to the temperature at which buildings and the like are maintained for human habitation and typically is about 70° F. The phrase "minimum dimension" as applied to a three dimensional article means the smallest dimension in the x, y or z axis.

While there has been shown and described what are considered to be preferred embodiments of the present invention, it will be apparent to those skilled in the art to which the invention pertains that various changes and modifications may be made therein without departing from the invention as defined in the appended claims.

It is claimed:

1. A process for treating an article of metal containing material having a minimum cross-sectional dimension, the process comprising providing the article at ambient temperature or below, completely immersing the article in a cryogenic fluid over a time period at least equal to t, where t is defined by:

$$t\ (\text{min.}=(k\ \text{minutes/inch cross-section}_{min})(\text{inches in minimium cross-section for article})$$

where k is at least 10 withdrawing the article from contact with the cryogenic fluid, and immediately subjecting the article to a flow of gaseous fluid sufficient to raise the temperature of the article until the article reaches ambient temperature.

2. The process of claim 1 wherein the immersion of the article into the cryogenic fluid is continuous.

3. The process of claim 2 wherein the immersion of the article into the cryogenic fluid is at a constant rate.

4. The process of claim 1 wherein the immersion into the cryogenic fluid is discontinuous comprising partially immersing the article into the cryogenic fluid, followed by at least one hold step followed by a further partial immersion of the article into the cryogenic fluid.

5. The process of claim 1 wherein the metal containing material of the article includes steel.

6. The process of claim 1 wherein the cryogenic fluid includes liquid nitrogen.

7. The process of claim 6 wherein the metal containing material of the article includes steel.

8. The process in accordance with claim 1 wherein the gaseous fluid is ambient air.

9. The process in accordance with claim 1 wherein the article is immersed with a major axis thereof oblique to a surface of the cryogenic fluid.

* * * * *